US005301581A

United States Patent [19]

Mohr

[11] Patent Number: 5,301,581

[45] Date of Patent: Apr. 12, 1994

[54] APPARATUS FOR CUTTING STACKED, SHEET-LIKE MATERIAL HAVING A SIDE STOP AND A PRESSING SLIDE MOVABLE AGAINST THE SAME FOR ALIGNING THE MATERIAL TO BE CUT

[76] Inventor: Wolfgang Mohr, Hundshager Weg 42, D-6238 Hofheim/Taunus, Fed. Rep. of Germany

[21] Appl. No.: 970,150

[22] Filed: Nov. 2, 1992

Related U.S. Application Data

[63] Continuation of Ser. No. 645,225, Jan. 24, 1991, abandoned.

[30] Foreign Application Priority Data

Jan. 25, 1990 [DE] Fed. Rep. of Germany ..... 4002101

[51] Int. Cl.[5] ..... B26D 7/01

[52] U.S. Cl. ..... 83/272; 83/271; 83/276; 83/282

[58] Field of Search ..... 83/153, 268, 269, 271, 83/278, 282, 418, 934, 272, 276

[56] References Cited

U.S. PATENT DOCUMENTS

| | | | |
|---|---|---|---|
| 2,329,890 | 9/1943 | Fisher | 83/418 |
| 3,290,977 | 12/1966 | Brestel et al. | 83/732 |
| 3,424,044 | 1/1969 | Thumin et al. | 83/268 |
| 3,847,386 | 11/1974 | Kruse | 271/171 |
| 4,850,257 | 7/1989 | Mohr | 83/93 |
| 4,922,773 | 5/1990 | Ito | 83/76.6 |

FOREIGN PATENT DOCUMENTS

| | | | |
|---|---|---|---|
| 0242763 | 10/1987 | European Pat. Off. | 83/93 |
| 0252418 | 1/1988 | European Pat. Off. | 83/86 |

*Primary Examiner*—Hien H. Phan

*Attorney, Agent, or Firm*—Robert P. Simpson; Michael L. Dunn

[57] ABSTRACT

An apparatus is provided for cutting stacked, sheet-like material, having a table surface which has a working zone, above which a cutting blade and a press beam are located, an entry zone behind the working zone for receiving the material to be cut and an exit zone in front of the working zone for receiving the cut material, a feed device for the material to be cut, which feed device has teeth which engage grooves of the press beam when the feed device is in its foremost position, and also a side stop for aligning the material to be cut by means of a pressing slide movable in the area of the working zone in the direction of the line of cut, where the feed device extends essentially over the entire width of the table surface, and the pressing slide is effective solely in the area of the working zone formed between the cutting plane and the foremost position of the feed device, thus allowing alignment of the material to be cut in direct proximity to the cutting plane.

14 Claims, 2 Drawing Sheets

Figure 1:
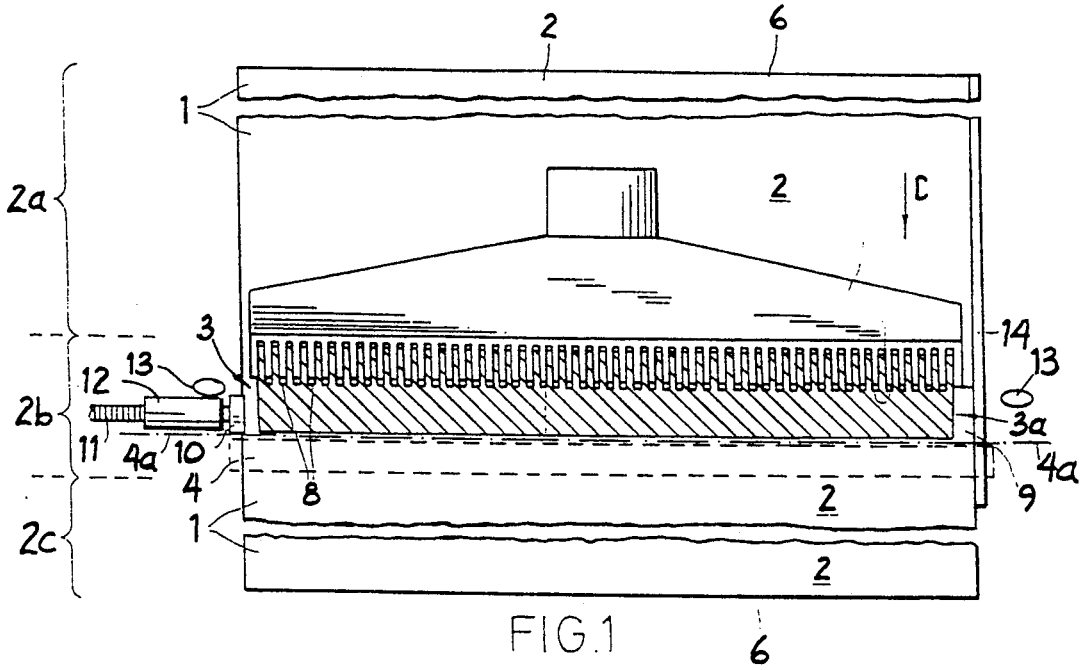

APPARATUS FOR CUTTING STACKED, SHEET-LIKE MATERIAL HAVING A SIDE STOP AND A PRESSING SLIDE MOVABLE AGAINST THE SAME FOR ALIGNING THE MATERIAL TO BE CUT

This is a continuation of application Ser. No. 07/645,225, filed Jan. 24, 1991, now abandoned.

The invention relates to an apparatus for cutting stacked, sheet-like material, having a table surface which has a working zone, above which a cutting blade and a press beam are located, an entry zone behind it for receiving the material to be cut and an exit zone in front of it for receiving the cut material, a feed device for the material to be cut, which feed device has teeth engaging in its foremost position in grooves of the press beam, and also a side stop for aligning the material to be cut by means of a pressing slide movable in the area of the working zone in the direction of the line of cut.

EP-0,242,763 A2 discloses an apparatus of this type. An automatically movable pressing slide is provided in this apparatus for pressing the material to be cut against the side stop, the effective width of the feed device being less than the distance between side stop and pressing slide. Since the effective width of the feed device is reduced relative to the normal machine width, the pressing slide can remain in situ without colliding with the feed device. The working strokes of the pressing slide and its actuating time are correspondingly short. Since it is actuated automatically, the time interval up to the following cut can also be kept small. On the whole, transverse alignment is obtained using a minimum of time in this configuration. Furthermore, it is quite easy to carry out the alignment before every cut. Furthermore, it is known from this publication to arrange the pressing slide above the working zone behind the effective plane of the press beam. In addition, it is proposed that the pressing slide can be moved first of all below the press beam when the same is raised and can then be moved in the pressing direction so that the pressing slide can be advanced as close to the line of cut as possible.

A disadvantage in the known apparatus is that, on account of the necessary smaller effective width of the feed device relative to the distance between side stop and pressing slide, the feed device has to be reset or exchanged each time for adaptation to various widths of the material to be cut. The apparatus can therefore only be used efficiently when uniform stack formats are to be cut in large quantities.

When cutting stacked, sheet-like material, especially when this material is present in a strip shape, it is considered to be particularly problematic in practice to align the material exactly at the side stop when the feed device is located virtually in the foremost position. Even when the feed device is provided with teeth and the press beam with corresponding grooves, and the parts mutually penetrate one another, an area in which a pressing slide can be used only with considerable technical outlay remains adjacent to the cutting plane below the press beam. This is especially because the press beam, in conventional apparatuses of the said type, is moved via draw rods which are arranged at the sides of the table and make access to the table surface arranged below this area of the press beam more difficult.

The object of the present invention is to develop further an apparatus of the said type in such a way that, in a simple constructional configuration of the apparatus in the area of the feed device, press beam, side stop and pressing slide, alignment of the material to be cut in direct proximity to the cutting plane is ensured.

This object is achieved in that the feed device extends essentially over the entire width of the table surface, and the pressing slide is effective solely in the area of the working zone formed between the cutting plane and the foremost position of the feed device. The configuration according to the invention of the apparatus first of all enables any stack formats to be cut without changing or exchanging the feed device. In this way, the apparatus can be of a universal configuration in the area of the feed device and can have, for example, the conventional spindle-driven feed saddles known in guillotine-type cutting machines. Unlike the prior art, the pressing slide is effective solely in the area of the working zone which cannot be reached by the feed device, which means that the pressing slide is of relatively narrow design. By the arrangement of the pressing slide in direct proximity to the cutting plane, any narrow sets, whether sets which extend over the entire width of the table or sets in the form of block strips, can be aligned exactly at the side stop. So that sets of any format can be aligned, the pressing slide should be movable essentially over the entire table width, thus at least into the vicinity of the side stop.

A particular embodiment of the invention provides for the pressing slide to be connected to a push rod arranged above the table surface and movable by power-transmission means parallel to the cutting plane in the direction of the line of cut. The push rod can be formed by the piston rod of a servo cylinder, in particular a pneumatically operable servo cylinder, which is arranged outside the working zone. The servo cylinder is advantageously fastened laterally to the table or to a portal frame of the apparatus, which portal frame accommodates the blade and the press beam. Furthermore, it is possible to design the push rod as a toothed rack with which a gear of a power-transmission means, for example an electric servo motor, arranged outside the working zone interacts.

The pressing slide, arranged parallel to the side stop can, for example, be rigidly connected to the end of the push rod facing the side stop. Since the pressing slide, in order to perform its function, is disposed above the stack to be cut, this rigid arrangement of the pressing slide means that it has to be moved out of its effective area before the press beam is lowered. Another advantageous construction provides for the push rod to be arranged directly adjacent to the table surface, and for the pressing slide to be pivotably connected about a horizontal axis to the end of the push rod facing the side stop. Here, the pressing slide is removed from the effective area of the press beam in a simple way by being pivoted below the upper boundary surface of the stack to be cut after the same is aligned, whereupon it can remain in direct proximity to the stack to be cut. In this embodiment, an adjusting means is provided for pivoting the pressing slide between the vertical working position and in particular an essentially horizontal inoperative position. The adjusting means should be designed as a rod which can be actuated by a power-transmission means and acts on the pressing slide at a distance from the pivot axis of the same. In order to ensure a defined position of the pressing slide in its working position, it is considered to be advantageous if it is supported in this position via a bearing surface on a corresponding bearing surface of the push rod.

The height of the pressing slide should be orientated to the maximum stack height of material to be cut which can be processed in the apparatus. In this context, provision is made for the pressing slide to extend in its working position essentially from the table surface up to slightly below the raised press beam.

The push rod is advantageously arranged between the cutting plane and a draw rod for the press beam. Therefore, despite the small space between the cutting plane, that is, the cutting blade and the feed device and the mechanism for actuating the press beam, sufficient space remains for moving the pressing slide in a defined manner.

Further features of the invention are described with reference to the figures and in the subclaims, all individual features and all combinations of individual features being essential to the invention.

Figure 2:
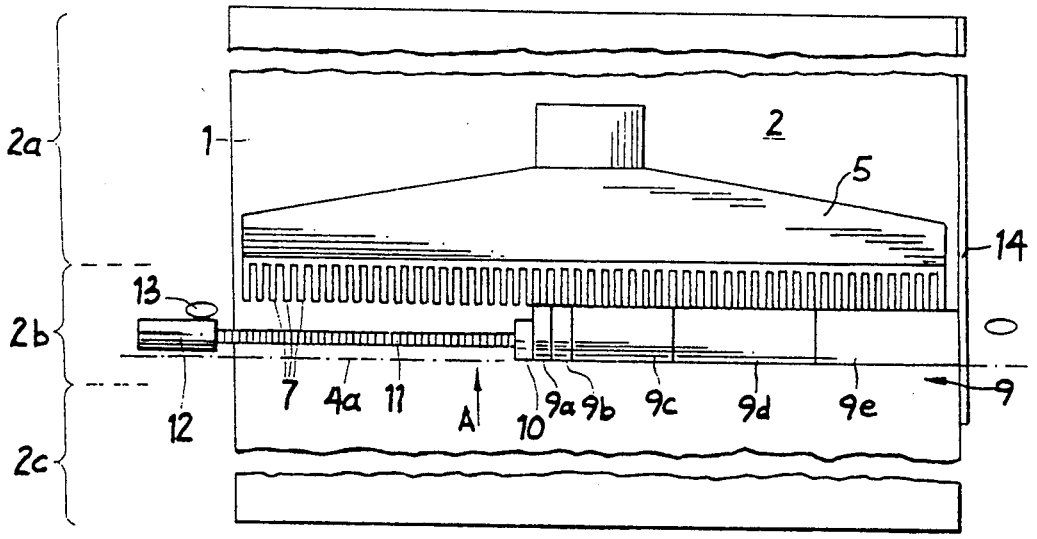
Figure 2A:
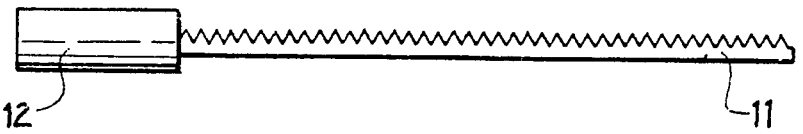
Figure 3:
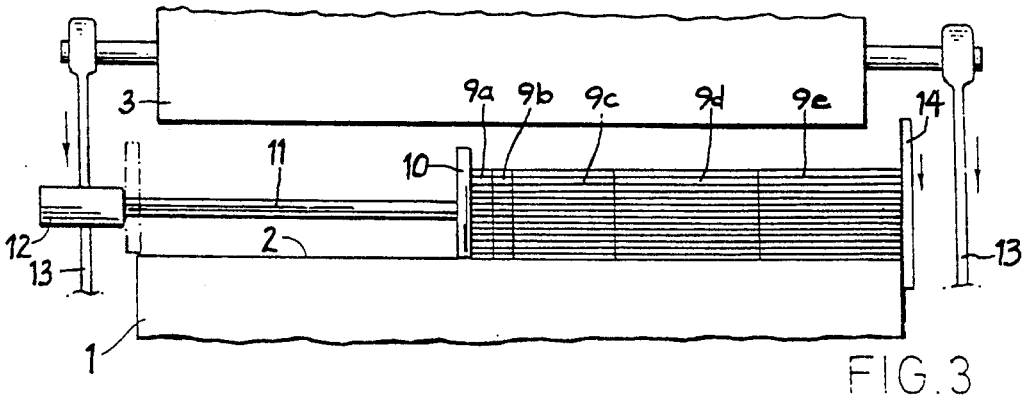
Figure 4:
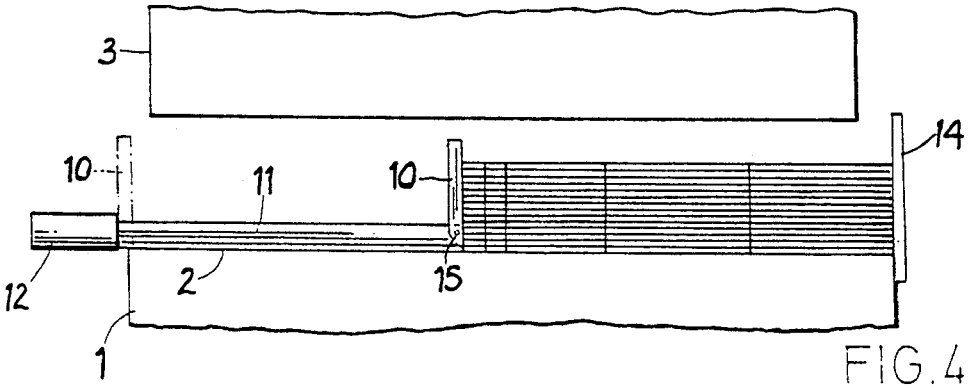
Figure 5:
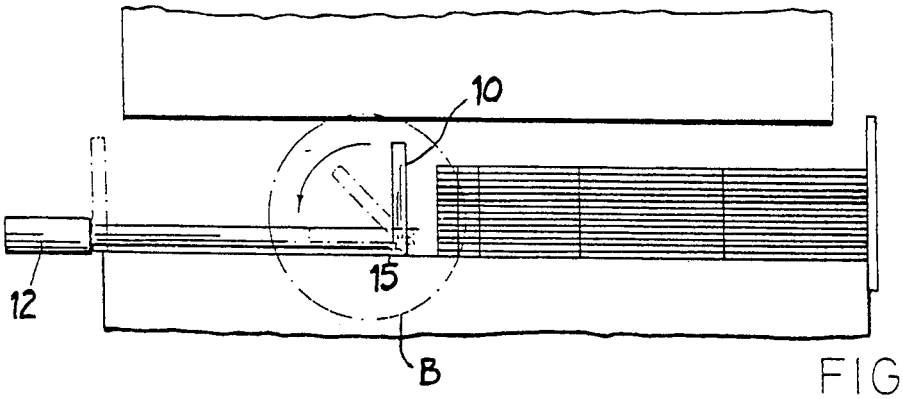
Figure 6:
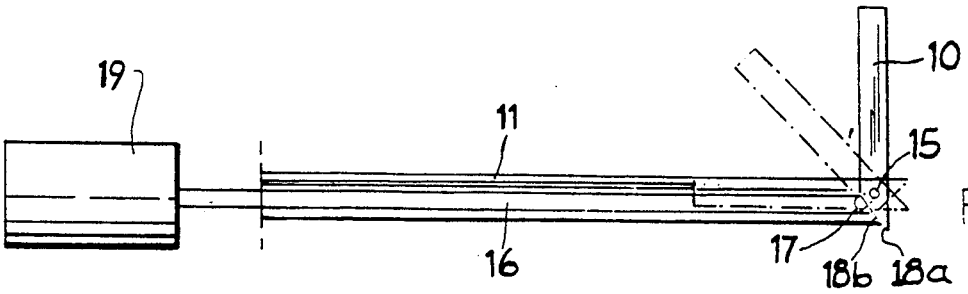

The invention is shown by way of example in the figures with reference to a fundamental embodiment plus two partial variants without being restricted to this embodiment. In the drawing:

FIG. 1 shows a greatly simplified representation of a guillotine-type cutting machine for cutting paper, cardboard or the like in plan view for the first partial variant with the pressing slide located outside the working zone, FIG. 2 shows a representation according to FIG. 1 with the pressing slide in operation, FIG. 2A is a side view of servo-motor 12 and push rod 11, which shows that push rod 11 is a toothed rack;

FIG. 3 shows an end view A according to FIG. 2 without the feed device,

FIG. 4 shows a view corresponding to FIG. 3 for a second partial view of the pressing slide in its working position, FIG. 5 shows a representation according to FIG. 4 with the pressing slide removed slightly from the material to be cut in order to illustrate the pivoting position of the pressing slide, and FIG. 6 shows a detailed representation B according to FIG. 5 for illustrating the interaction of push rod, pressing slide and rod for actuating the pressing slide Shown in FIG. 1 for the guillotine-type cutting machine is first of all a table 1 having a table surface 2 which is subdivided into an entry zone 2*a*, a working zone 2*b* and an exit zone 2*c*. The entry zone 2*a* serves to receive the material to be cut; a press beam 3 accommodated by a portal frame (not shown) of the cutting machine and a cutting blade 4 (only shown by broken lines) are arranged above the working zone 2*b*. The cutting plane of the cutting blade 4 is illustrated by the reference numeral 4*a*. The exit zone 2*c* serves to receive the cut material. In the entry zone 2*a*, a feed device in the form of a feed saddle 5 is mounted so as to be movable in feed direction C. The width of the feed saddle 5 is only marginally less than the narrow edges 6 of the table 1, which narrow edges 6 define the width of the table 1. On the side facing the press beam, the feed saddle is of comb-like design seen in plan view and thus has a multiplicity of uniformly spaced teeth 7 (see also FIG. 2). Accordingly, the press beam 3, on its side facing the feed saddle 5, is provided with grooves 8 into which the teeth 7 can engage. The maximum advanced position of the feed saddle 5 is shown in FIG. 1, that is, the nearest position which the feed saddle 5 can assume with regard to the cutting plane 4*a*. In this position, the teeth 7 of the feed saddle 5 engage fully into the grooves 8 of the press beam 3 so that a clearance space remains below the groove-free area 3*a* of the press beam 3.

So that material 9 to be cut which is located in this clearance space can be aligned with a side straight-edge 14, a pressing slide 10 is provided which can be moved in the direction of the line of cut—likewise illustrated by the reference numeral 4*a* in the plan view according to the representation in FIGS. 1 and 2—towards the material 9 to be cut. As shown in FIGS. 1 to 5, the pressing slide 10 is connected to a push rod 11 arranged above the table surface 2 and movable parallel to the cutting plane 4*a* likewise in the direction of the line of cut. The push rod is designed as a toothed rack with which a gear 19 of a servo motor 12 arranged outside the working zone 2*b* interacts. This servo motor 12 and thus also the push rod 11 are arranged between one of the two draw rods 13 for drawing down the press beam 3 and the cutting plane 4*a*.

For the first partial variant, FIGS. 1 to 3 show that the push rod 11 is rigidly connected to the centre area of the pressing slide 10 of plate-shaped design. The pressing slide 10 arranged parallel to the side stop 14 extends essentially from the table surface 2 up to slightly below the raised press beam 3 and, on account of the area of the pressing slide 10 projecting above the material 9 to be cut, enables any stack which can be processed with the apparatus to be aligned.

FIGS. 2 and 3 illustrate the relationships during the last cut of five block strips 9*a* to 9*e*, which cut is made in direct proximity to the cutting blade 4. The block strips are fed to the cutting plane 4*a* by means of the feed saddle 5 when the pressing slide 10 is moved out of the working zone 2*b*. As shown in FIG. 2, the push rod 11 having the pressing slide 10 is then extended until the latter bears on the outside against the block strip 9*a* and on the whole presses the material 9 to be cut against the side straightedge 14 and as a result laterally aligns it. This position is likewise illustrated in the front view according to FIG. 3. After the alignment, the pressing slide 10 is retracted from the area below the press beam 3 into the position shown by broken lines; the side stop 14 is then lowered in the direction of the arrow, and the press beam is pressed down in the direction of the arrow by the action of the draw rods 13 onto the material to be cut; and finally the cut is made by means of the cutting blade 4. As shown in FIG. 2A, which illustrates servo-motor 12 and push rod 11 in a side view, the push rod is actually a toothed rack.

FIGS. 4 to 6 illustrate an alternative arrangement of the pressing slide 10 on the push rod 11. The representation of the actuating means for the press beam 3 has been omitted here. As apparent from these figures, the push rod 11 is arranged there directly adjacent to the table surface 2, and the pressing slide 10 is pivotably connected about a horizontal axis 15 to the end of the push rod 11 facing the side stop 14. As illustrated in the representation in FIG. 6, a further rod 16 is run next to the push rod 11, with which further rod 16 the pressing slide can be pivoted anti-clockwise through a maximum of 90°, thus into a horizontal position. For this purpose, the rod 16 acts at a distance from the pivot axis 15 on an extension 17 of the pressing slide 10. At its lower end, this extension 17 is provided with a 45° bevel 18*a* which comes into contact with a corresponding 45° bevel of the push rod 11 in the vertical position of the pressing slide 10 and thus fixes the latter in a defined manner. The rod 16 can be moved, for example, by means of a pneumatic cylinder 19, in which case the rod 16 could represent its piston rod. An important advantage of the variant according to FIGS. 4 to 6 is that the pressing slide 10 need not be fully retracted before the press beam 3 is pressed down, but that it is sufficient to swing in the pressing slide 10 after it has been moved slightly from the stack of material to be cut.

I claim:

1. Apparatus for cutting stacked, sheet-like material, having a table surface which has a working zone, above which a cutting blade and a press beam are located, an entry zone behind the working zone for receiving the material to be cut and an exit zone in front of the working zone for receiving the cut material, a feed device for the material to be cut, which feed device has teeth engaging in its foremost position in grooves of the press beam, and also a side stop for aligning the material to be cut by means of a pressing slide movable in the area of the working zone in the direction of the line of cut, wherein the feed device extends essentially over the entire width of the table surface, and the pressing slide is effective solely in the area of the working zone formed between a cutting plane and the foremost position of the feed device wherein the pressing slide is connected to a push rod arranged above the table surface and movable by power-transmission means parallel to the cutting plane in the direction of the line of cut, wherein the push rod is arranged between the cutting plane and a draw rod for the press beam, characterized in that the push rod is arranged directly adjacent to the table surface, and the pressing slide is pivotably connected about a horizontal axis to the end of the push rod facing the side stop.

2. Apparatus as recited in claim 1, characterized in that an adjusting means is provided for pivoting the pressing slide between the vertical working position and an essentially horizontal inoperative position.

3. Apparatus as recited in claim 2, characterized in that the adjusting means comprises a rod which can be actuated by a power-transmission means and acts on the pressing slide at a distance from the pivot axis of the same.

4. Apparatus as recited in claim 1, characterized in that the pressing slide is supported in its working position via a bearing surface on a corresponding bearing surface of the push rod.

5. Apparatus according to claim 1, characterized in that the pressing slide is movable essentially over the entire table width.

6. Apparatus according to claim 1, characterized in that the push rod is formed by the piston rod of a servo cylinder, in particular a pneumatically operated servo cylinder, which is arranged outside the working zone.

7. Apparatus according to claim 1, characterized in that the push rod comprises a toothed rack with which a gear of a power-transmission means arranged outside the working zone interacts.

8. Apparatus according to claim 1, characterized in that the pressing slide, arranged parallel to the side stop, is rigidly connected to the end of the push rod facing the side stop.

9. Apparatus according to claim 1, characterized in that the push rod is arranged directly adjacent to the table surface, and the pressing slide is pivotably connected about a horizontal axis to the end of the push rod facing the side stop.

10. Apparatus according to claim 9, characterized in that an adjusting means is provided for pivoting the pressing slide between the vertical working position and an essentially horizontal inoperative position.

11. Apparatus according to claim 10, characterized in that the adjusting means comprises a rod which can be actuated by a power-transmission means and acts on the pressing slide at a distance from the pivot axis of the same.

12. Apparatus according to claim 9, characterized in that the pressing slide is supported in its working position via a bearing surface on a corresponding bearing surface of the push rod.

13. Apparatus according to claim 1, characterized in that the pressing slide extends in its working position essentially from the table surface up to slightly below the raised press beam.

14. Apparatus according to claim 1, characterized in that the side stop is movable out of the path of movement of the press beam, in particular swung downwards.

* * * * *